US005158054A

United States Patent [19]

Otsuka

[11] Patent Number: 5,158,054

[45] Date of Patent: Oct. 27, 1992

[54] MALFUNCTION DETECTION APPARATUS FOR DETECTING MALFUNCTION IN EVAPORATED FUEL PURGE SYSTEM

[75] Inventor: Takayuki Otsuka, Susono, Japan

[73] Assignee: Toyota Jidosha Kabushiki Kaisha, Toyota, Japan

[21] Appl. No.: 774,589

[22] Filed: Oct. 10, 1991

[30] Foreign Application Priority Data

Oct. 15, 1990 [JP] Japan ..... 2-275608

[51] Int. Cl.[5] ..... F02M 33/02; F02B 77/00

[52] U.S. Cl. ..... 123/198 D; 123/520

[58] Field of Search ..... 123/518, 519, 520, 521, 123/516, 198 D, 479

[56] References Cited

U.S. PATENT DOCUMENTS

| | | | |
|---|---|---|---|
| 3,680,318 | 8/1972 | Nakajima | 123/519 |
| 4,467,769 | 8/1984 | Matsumura | 123/520 |
| 4,641,623 | 2/1987 | Hamburg | 123/520 |
| 4,867,126 | 9/1989 | Yonekawa | 123/198 D |
| 4,949,695 | 8/1990 | Uranishi et al. | 123/520 |
| 4,962,744 | 10/1990 | Uranishi | 123/198 D |
| 5,085,194 | 2/1992 | Kuroda | 123/198 D |

FOREIGN PATENT DOCUMENTS 130255 5/1990 Japan .

*Primary Examiner*—Carl S. Miller

*Attorney, Agent, or Firm*—Kenyon & Kenyon

[57] ABSTRACT

An apparatus for detecting a malfunction in an evaporated fuel purge system for use in an internal combustion engine. The apparatus includes a vapor passage connecting a fuel tank to a canister for feeding fuel vapor from the fuel tank into the canister, a purge passage connecting the canister to an intake passage of the engine for feeding the fuel vapor adsorbed in an adsorbent in the canister into the intake passage, an air inlet passage connecting an air inlet port of the canister to the atmosphere, a first control valve provided for controlling a flow of the adsorbed fuel vapor from the canister to the intake passage, a pressure sensor provided for outputting a signal indicative of a pressure in the air inlet passage, a second control valve for controlling a flow of external air fed into the vapor passage from the air inlet port of the canister, and a malfunction detection part responsive to the signal outputted by the pressure sensor for detecting a malfunction in the evaporated fuel purge system.

7 Claims, 4 Drawing Sheets

MALFUNCTION DETECTION APPARATUS FOR DETECTING MALFUNCTION IN EVAPORATED FUEL PURGE SYSTEM

BACKGROUND OF THE INVENTION (1) Field of the Invention

The present invention generally relates to a malfunction detection apparatus, and more particularly to an apparatus for detecting a malfunction in an evaporated fuel purge system which is provided in an internal combustion engine for purging evaporated fuel, or fuel vapor, into an intake system of the internal combustion engine under given operating conditions and for adsorbing the fuel vapor in an adsorbent in a canister, so that an air-fuel mixture is fed into a combustion chamber in the internal combustion engine.

(2) Description of the Related Art

A conventional evaporated fuel purge system is provided in an internal combustion engine in order to temporarily adosrb evaporated fuel, or fuel vapor evaporated in a fuel tank, in an adsorbent in a canister, and for purging the adsorbed fuel vapor in the canister into an intake passage of the internal combustion engine. This evaporated fuel purge system generally has a vapor passage connecting the fuel tank to the canister, a purge passage connecting the canister to the intake passage of the engine, and a purge control valve provided at an intermediate portion in the purge passage.

A malfunction detection apparatus for detecting a malfunction in the evaporated fuel purge system is known, for example, Japanese Laid-Open Patent Application No.2-130255 discloses such a known malfunction detection apparatus. In this conventional malfunction detection apparatus, a pressure sensor is provided in the purge passage between the canister and the purge control valve for outputting a signal indicating a flow of the air-fuel mixture in the purge passage. A malfunction in the evaporated fuel purge system can be detected by the malfunction detection apparatus in response to the signal outputted by the pressure sensor. Such malfunctions detected by the conventional apparatus include, for example, a clogging of an air inlet passage of the canister, a problem of the purge control valve, and a clogging or pipe separation of the purge passage.

However, the conventional apparatus is unable to detect a flow of air in the air inlet passage of the canister, and there is a problem in that a malfunction having occurred in the air inlet passage of the canister, or in the fuel tank, or in the canister, cannot be suitably detected by the conventional apparatus.

SUMMARY OF THE INVENTION

Accordingly, it is a general object of the present invention to provide an improved malfunction detection apparatus in which the above described problems of the conventional apparatus are eliminated.

Another and more specific object of the present invention is to provide a malfunction detection apparatus which can suitably detect a malfunction in any part of the evaporated fuel purge system including a fuel tank, a canister and a vapor passage provided therebetween, by making use of a pressure sensor and a diagnosis-use control valve, both provided in an air inlet passage connecting the canister to the atmosphere. The malfunction detection is performed by the malfunction detection apparatus by comparing with a predetermined reference value a pressure in the air inlet passage indicated by a signal outputted by the pressure sensor, both when the diagnosis-use control valve and the purge control valve are closed, and when the diagnosis-use control valve is closed and the purge control valve is open. The above mentioned object of the present invention is achieved by an evaporated fuel purge system which includes a fuel tank in which fuel is evaporated into a fuel vapor, a canister containing an adsorbent for adsorbing the fuel vapor from the fuel tank, an air inlet port at a bottom portion of the canister, and an air inlet passage connecting the air inlet port to the atmosphere, a vapor passage connecting the fuel tank to the canister for feeding the fuel vapor from the fuel tank into the canister, a purge passage connecting the canister to an intake passage of the internal combustion engine for feeding the adsorbed fuel vapor in the adsorbent in the canister into the intake passage, a first control valve provided at an intermediate portion in the purge passage for controlling a flow of the adsorbed fuel vapor being fed, due to a vacuum pressure in the intake passage, from the canister to the intake passage, a second control valve provided in the air inlet passage of the canister for controlling a flow of external air being fed, due to a vacuum pressure in the vapor passage, into the vapor passage through the canister, a pressure sensor provided at an intermediate portion in the air inlet passage between the canister and the second control valve for outputting a signal indicating pressure in the air inlet passage, a valve control part for controlling opening and closing operations of each of the first and second control valves when a malfunction detection is made, and a malfunction detection part responsive to the signal outputted by the pressure sensor for determining whether there is a malfunction in the evaporated fuel purge system, wherein a malfunction detection is made by the malfunction detection part, both when the first and second control valves are closed by the valve control part, and when the second control valve is closed and the first control valve is opened by the valve control part. According to the present invention, it is possible to detect suitably a malfunction in the whole evaporated fuel purge system including the fuel tank, the canister, the vapor passage, the purge control valve, the purge passage and the air inlet passage, by making use of a pressure sensor and a control valve which are provided in the air inlet passage, thus increasing the reliability of the evaporated fuel purge system. The malfunction detection apparatus according to the present invention is very useful for an internal combustion engine in practical use.

Other objects and further features of the present invention will become more apparent from the following detailed description when read in conjunction with the accompanying drawings.

DESCRIPTION OF THE PREFERRED EMBODIMENT

Figure 1:
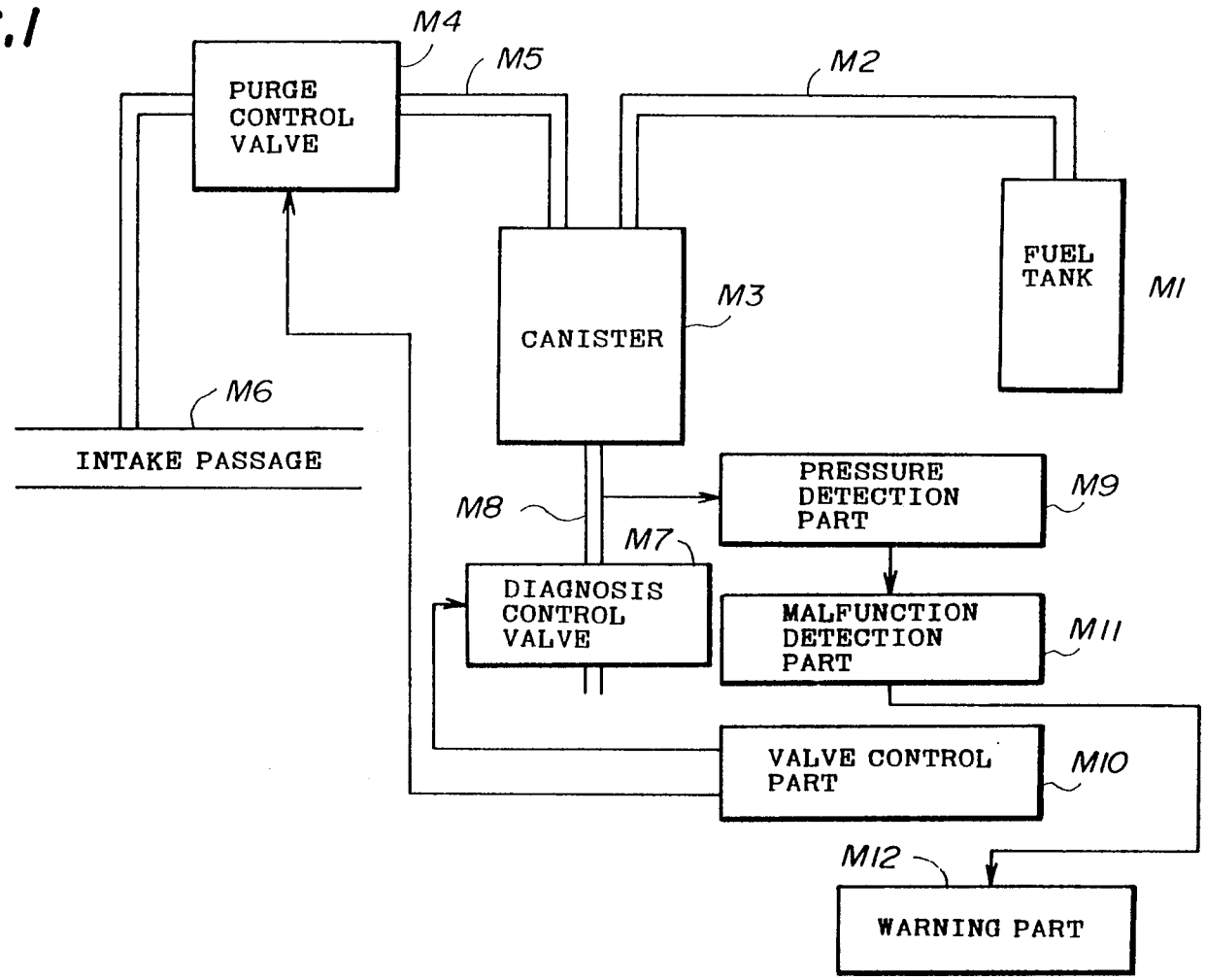
FIG. 1 is a block diagram for explaining the construction of a malfunction detection apparatus according to the present invention.

A description will now be given of the construction of a malfunction detection apparatus according to the present invention, with reference to FIG. 1. In FIG. 1, an evaporated fuel or fuel vapor in a fuel tank M1 is fed into a canister M3 through a vapor passage M2. The fuel vapor adsorbed in the canister M3 is purged by a purge control valve M4 into an intake passage M6 of an internal combustion engine via a purge passage M5. The purge control valve M4 is provided at an intermediate portion of the purge passage M5. A diagnosis control valve M7 is provided in an air inlet passage M8 of the canister M3 leading to the atmosphere, for controlling a flow of external air being fed into the canister M3 from the atmosphere. A pressure detection part M9 is provided in the air inlet passage M8 between the canister M3 and the diagnosis control valve M7, for outputting a signal indicating pressure in the air inlet passage M8. A valve control part M10 is provided for controlling the operations of the purge control valve M4 and the diagnosis control valve M7 so that the valves M4, M7 are opened and closed at suitable times when a malfunction detection procedure is performed. A malfunction detection part M11, responsive to the output signal of the pressure detection part M9, is provided for determining whether a malfunction has occurred in the evaporated fuel purge system, by comparing the pressure indicated by the output signal of the pressure detection part with a predetermined value. A warning part M12 gives a warning of the malfunction to a driver when the malfunction detection part M9 detects the malfunction in the evaporated fuel purge system.

The malfunction detection apparatus according to the present invention makes it possible to suitably detect a malfunction in the evaporated fuel purge system including the fuel tank M1, the vapor passage M2, the canister M3, the purge control valve M4, the purge passage M5 and the air inlet passage M8. By comparing the pressure in the air inlet passage M8 indicated by the pressure detection part M9 when the diagnosis control valve M7 and the purge control valve M4 are closed, with a predetermined value, a malfunction which occurs in the fuel tank M1, the vapor passage M2, the canister M3, the purge control vale M4, the purge passage M5 and the air inlet passage M8 can be detected. Also, by comparing the pressure in the air inlet passage M8 indicated by the pressure detection part M9 when the purge control valve M4 is opened, with a predetermined value, a malfunction which occurs in the canister M3, the purge passage M5 and the air inlet passage M8 can be detected.

Figure 2:
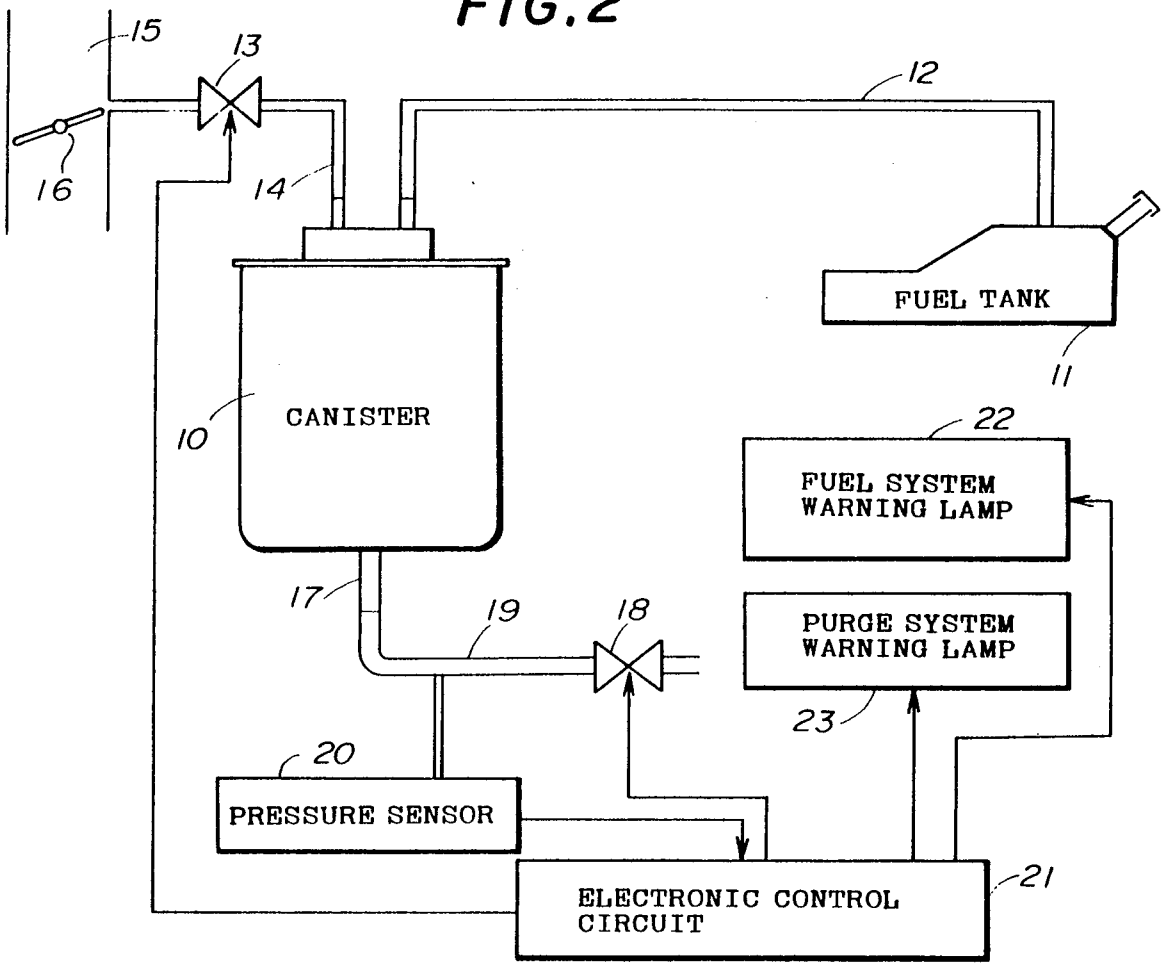
FIG. 2 is a view showing schematically an evaporated fuel purge system to which an embodiment of the malfunction detection apparatus of the present invention is applied.

FIG. 2 shows an evaporated fuel purge system to which the present invention is applied. In FIG. 2, a canister 10 and a fuel tank 11 are connected by a vapor passage 12, so that evaporated fuel or fuel vapor in the fuel tank 11 is fed into the canister 10 through the vapor passage 12 and adsorbed in an adsorbent in the canister 10. The canister 10 is also connected by a purge passage 14 to an intake passage 15 of an internal combustion engine, so that the adsorbed fuel vapor in the canister 10 is fed into the intake passage 15. At an intermediate portion of the purge passage 14, a purge control valve 13 is provided for controlling a flow of the fuel vapor into the intake passage 15, and this purge control valve 13 is, for example, a vacuum switching valve (VSV) which is switched ON and OFF by an electrical signal. The purge passage 14 is connected to the intake passage 15 at a portion immediately upstream of a throttle valve 16 which is provided in the intake passage 15, for controlling a flow of an air-fuel mixture fed into a combustion chamber of the internal combustion engine, and this throttle valve 16 is set at the fully closed position. The canister 10 has an air inlet 17 at its bottom end, and the air inlet 17 of the canister 10 is connected to an air inlet passage 19 leading to the atomosphere. At an intermediate portion of the air inle passage 19, a diagnosis control valve 18 is provided for controlling a flow of air between the canister 10 and the atmosphere, and this diagnosis control valve 18 is, for example, a vacuum switching valve (VSV) as described above.

A pressure sensor 20 is provided in the air inlet passage 19 at a portion between the canister 10 and the diagnosis control valve 18, for outputting a signal indicating pressure in the air inlet passage 19. A signal outputted by the pressure sensor 20 is sent to an electronic control circuit 21. The electronic control circuit 21 responds by performing a malfunction detection procedure, while controlling the valve opening and closing operations of each of the vacuum switching valves 13 and 18 at suitable times in performing a malfunction detection.

If the pressure in the air inlet passage 19 indicated by the output signal of the pressure sensor 20 is not a positive pressure when the purge control VSV 13 and the diagnosis control VSV 18 are switched OFF, then it is determined that a malfunction has occurred in a fuel system included in the evaporated fuel purge system, and the electronic control circuit 21 turns ON a fuel system warning lamp 22 so that a warning of the malfunction thus located is given to a driver. The fuel systems included in the above malfunction detection case include the canister 10, the fuel tank 11, the vapor passage 12 and the air inlet passage 19. Also, if the pressure in the air inlet passage 19 indicated by the output signal of the pressure sensor 20 is not a negative pressure when the diagnosis control valve 18 remains in an "OFF" state and the purge control valve 13 is switched ON, then it is determined that a malfunction has occurred in a purge system included in the evaporated fuel purge system, and the electronic control circuit 21 turns ON a purge system warning lamp 23 so that a warning of the malfunction thus located is given to a driver. The purge systems included in the above case include the canister 10, the purge control valve 13 and the purge passage 14.

Next, a description will be given of a malfunction detection procedure which is performed by the eletronic control circuit 21 in the present embodiment of the malfunction detection apparatus, with reference to FIGS. 3 through 5. The malfunction detection procedure shown in FIG. 3 is part of a main routine performed by the electronic control circuit 21.

Figure 3:
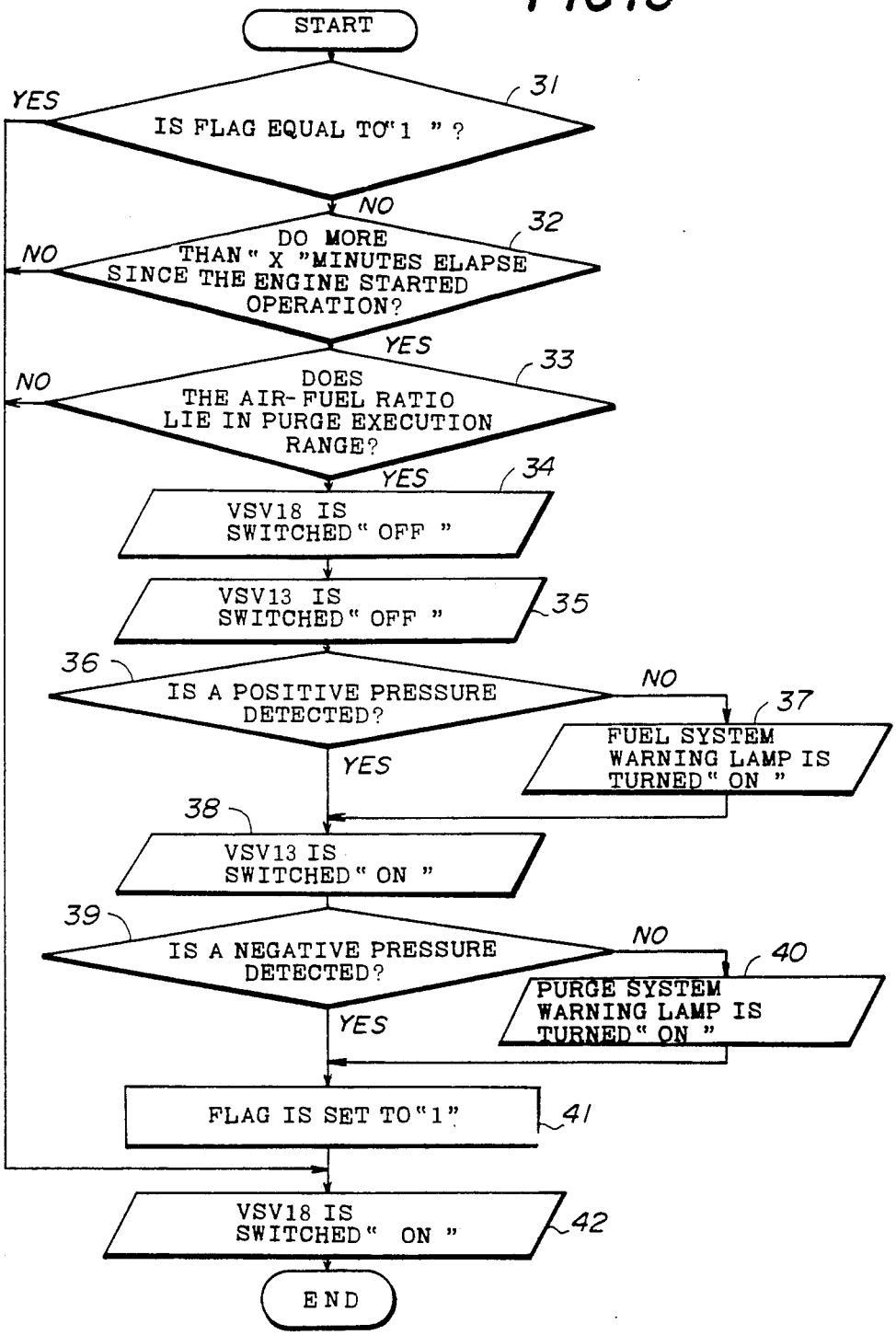
FIG. 3 is a flow chart for explaining a malfunction detection procedure which is performed in the embodiment of the present invention.

In the flow chart shown in FIG. 3, a step 31 determines whether an execution flag is equal to "1" or not. This execution flag is preset to zero when the engine starts operation, and the execution flag normally is equal to zero in the step 31. If the step 31 determines that the execution flag is equal to zero, then a step 32 determines whether more than a predetermined time period of "x" minutes has elapsed since the engine started operation. This time period of "x" minutes is preset to 20 to 30 minutes, for example, which is approximately equal to the time required for the internal pressure of the fuel tank 11 to reach a predetermined high pressure while the engine is in the idling condition. If the step 32 determines that the predetermined time period of "x" minutes has elapsed since the engine started operation, then a step 33 determines whether the load on the engine is greater than a predetermined value and whether an air-fuel ratio at that time lies in a predetermined purge execution region. The air-fuel ratio lying in the purge execution range signifies a condition in which the adsorbed fuel vapor in the canister 10 is purged into the intake passage 15 of the engine.

If the step 33 determines that the air-fuel ratio lies in the purge execution range, then a step 34 switches OFF the diagnosis control valve 18, so that the air inlet passage 19 is closed, thereby preventing external air from entering the air inlet 17 of the canister 10. A step 35 switches OFF the purge control valve 13 so that the purging of fuel vapor into the intake passage 15 is not performed through the purge control valve 13. Following the step 35, a step 36 determines whether a pressure in the air inlet passage 19 indicated by an output signal of the pressure sensor 20 is a positive pressure or not.

Figure 4:
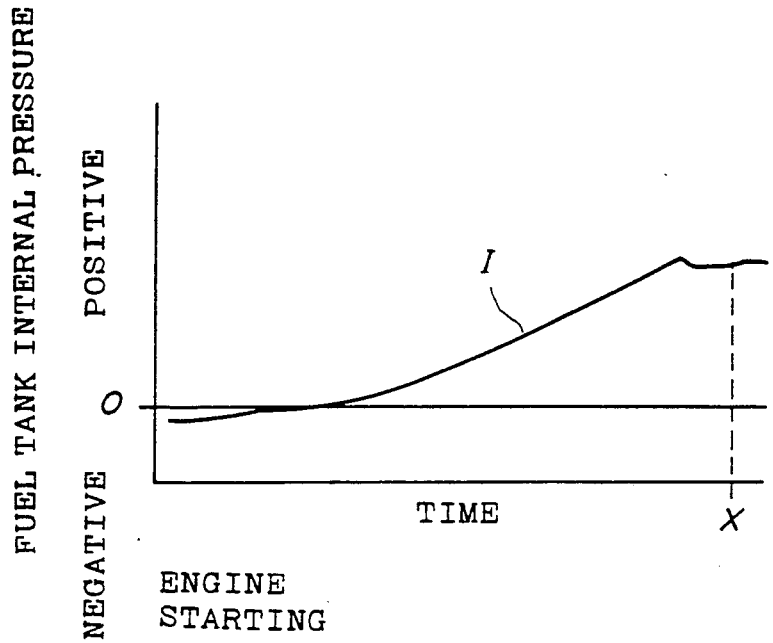
FIG. 4 is a chart showing changes in the internal pressure of the fuel tank with respect to the elapsing time.

FIG. 4 is a chart showing changes in the internal pressure of the fuel tank 11 with respect to time elapsed since the engine started operation. As indicated by a solid line I in FIG. 4, the internal pressure of the fuel tank 11 gradually increases from the time the engine starts. This pressure normally reaches a certain positive pressure by the time the period of "x" minutes elapses since the engine started operation. Thus, when the purge control valve 13 and the diagnosis control valve 18 are both closed, the pressure in the air inlet passage 19 is at a positive pressure above the atmospheric pressure and the output signal of the pressure sensor 20 indicates a positive pressure, provided there is no malfunction in the canister 10, the fuel tank 11, the vapor passage 12, the purge control valve 13 or the air inlet passage 19.

Therefore, if the step 37 determines that the pressure indicated by the output signal of the pressure sensor 20 is not a positive pressure, then a step 37 switches ON the fuel supply system warning lamp 22 so that a warning of the malfunction located especially in a fuel system included in the evaporated fuel purge system to a driver.

After the above procedure is performed, a step 38 switches ON the purge control valve 13 so that the purge passage 14 is opened and the adsorbed fuel in the canister 10 is purged into the intake passage 15, and a step 38 determines whether a pressure in the air inlet passage 19 indicated by an output signal of the pressure sensor 20 is a negative pressure or not.

Figure 5:
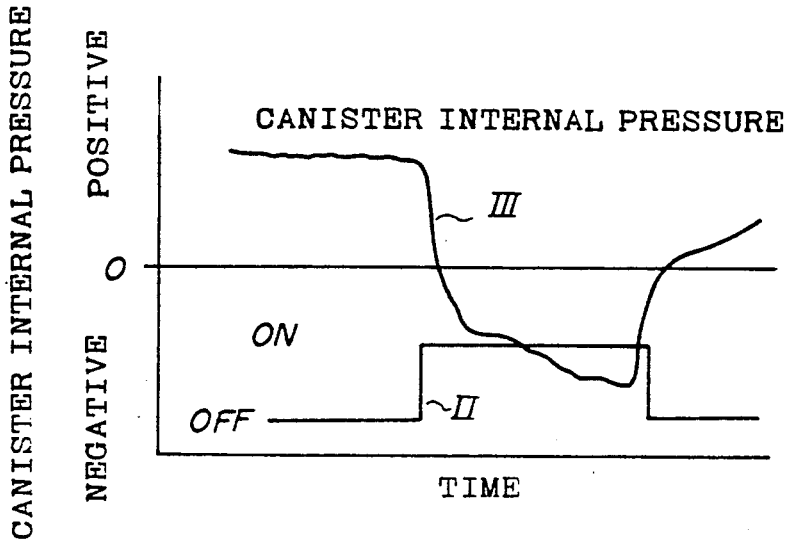
FIG. 5 is a chart showing changes in the internal pressure of the canister when the purge control valve is changed from "OFF" state to "ON" state.

FIG. 5 shows schematically changes in the internal pressure of the canister 10 when the purge control valve 13 is switched ON. When the diagnosis control valve 18 is at the closed position and the purge control valve 13 is switched ON in the purge execution range by a control signal applied to the valve 13, as indicated by a solid line II in FIG. 5, the intake passage 15 of the engine is normally at a negative pressure at this time, and the internal pressure of the canister 10 rapidly decreases and becomes a negative pressure below the atmospheric pressure as indicated by a solid line III in FIG. 5. Therefore, the output signal of the pressure sensor 20 normally indicates a negative pressure provided no malfunction has occurred in the canister 10, the purge control valve 13, the purge passage 14, or the air inlet passage 19. Thus, if the step 39 determines that the pressure in the air inlet passage 19 indicated by the output signal of the pressure sensor 20 is not a negative pressure, a step 40 switches ON the purge system warning lamp 23 so that a warning of the malfunction located in a purge system included in the evaporated fuel purge system is given to a vehicle driver.

Following the above mentioned procedure, a step 41 sets the purge execution flag to "1". This flag is used for instructing the electronic control circuit 21 to perform a purging of fuel vapor into the intake passage 15 by means of the purge control valve 13. A step 42 switches ON the diagnosis control valve 18 so that the air inlet passage 19 opens to the atmosphere, and the malfunction detection procedure ends.

In cases in which the step 31 determines that the purge execution flag is equal to "1", in which the step 32 determines that the predetermined time period of "x" minutes has not elapsed since the engine started operation, or in which the step 33 determines that the air-fuel ratio does not lie in the purge execution range, the step 42 is performed so that the diagnosis control valve 18 is switched ON and the malfunction detection procedure is completed.

As described above, according to the present invention, it is possible to suitably detect a malfunction in any part of the evaporated fuel purge system including the fuel tank, the canister, the vapor passage, the purge control valve, the purge passage and the air inlet passage, by making use of a pressure sensor and a control valve provided in the air inlet passage. This increases the reliability of the evaporated fuel purge system. The malfunction detection apparatus according to the present invention is useful for an internal combustion engine in practical use.

Further, the present invention is not limited to the above described embodiment, and variations and modifications may be made without departing from the scope of the present invention.

What is claimed is:

1. An evaporated fuel purge system for use in an internal combustion engine, comprising:

a fuel tank in which fuel is evaporated into a fuel vapor;

a canister containing an adsorbent for adsorbing the fuel vapor from the fuel tank, an air inlet port at a bottom portion of the canister, and an air inlet passage connecting the air inlet port to the atmosphere;

a vapor passage connecting said fuel tank to said canister for feeding the fuel vapor from said fuel tank into said canister;

a purge passage connecting said canister to an intake passage of the internal combustion engine for feeding the adsorbed fuel vapor in said adsorbent in said canister into said intake passage;

a first control valve provided at an intermediate portion in said purge passage for controlling a flow of the adsorbed fuel vapor being fed, due to a vacuum pressure in said intake passage, from said canister to said intake passage;

a second control valve provided in said air inlet passage of said canister for controlling a flow of external air being fed, due to a vacuum pressure in said vapor passage, into the vapor passage through the canister;

a pressure sensor provided at an intermediate portion in said air inlet passage between said canister and said second control valve for outputting a signal indicating pressure in said air inlet passage;

valve control means for controlling opening and closing operations of each of said first and second control valves when a malfunction detection is made; and malfunction detection means, responsive to said signal outputted by said pressure sensor, for determining whether there is a malfunction in said evaporated fuel purge system, wherein a malfunction detection is made by said malfunction detection means, both when the first and second control valves are closed by said valve control means, and when the second control valve is closed and the first control valve is opened by said valve control means.

2. The system as claimed in claim 1, further comprising warning means for giving a warning of the malfunction to a driver when said malfunction has been detected in said evaporated fuel purge system by said malfunction detection means.

3. The system as claimed in claim 2, wherein said warning means includes a first warning lamp which is turned ON when the malfunction has been detected by said malfunction detection means in said fuel tank, said vapor passage, said canister or said air inlet passage, and a second warning lamp which is turned ON when the malfunction has been detected by said malfunction detection means in said canister, said first control valve or said purge passage.

4. The system as claimed in claim 1, wherein said first control valve includes a vacuum switching valve which is switched ON by said valve control means when the first and second control valves are both closed and a pressure in said air inlet passage indicated by a signal outputted by the pressure sensor is a positive pressure.

5. The system as claimed in claim 1, wherein said malfunction detection means determines that there is a malfunction in said evaporated fuel purge system, when the first and second control valves are closed and a pressure in said air inlet passage indicated by a signal outputted by said pressure sensor is not a positive pressure.

6. The system as claimed in claim 1, wherein said malfunction detection means determines that there is a malfunction in said evaporated fuel purge system, when the second control valve is closed and the first control valve is opened by said valve control means and a pressure in said air inlet passage indicated by a signal outputted by said pressure sensor is not a negative pressure.

7. The system as claimed in claim 1, wherein said second control valve includes a vacuum switching valve which is switched ON by said valve control means when the second control valve is closed and the first control valve is opened by said valve control means and a pressure in said air inlet passage indicated by a signal outputted by said pressure sensor is a negative pressure.

* * * * *

UNITED STATES PATENT AND TRADEMARK OFFICE

CERTIFICATE OF CORRECTION

PATENT NO. : 5,158,054

DATED : October 27, 1992

INVENTOR(S) : Takayuki OTSUKA

It is certified that error appears in the above-indentified patent and that said Letters Patent is hereby corrected as shown below:

Column 1, line 21, change "adosrb" to --absorb--.

Column 3, line 52, change "vale" to --valve--.

Column 4, line 16, change "inle" to --inlet--.

Column 4, line 56, change "ele-" to --elec---.

Column 5, line 47, after "malfunction" insert a comma.

Column 5, line 48, after "system" insert a comma and add --is given-- before "to a driver".

Signed and Sealed this

Twenty-sixth Day of September, 1995

*Attest:*

Bruce Lehman

BRUCE LEHMAN

*Attesting Officer*

*Commissioner of Patents and Trademarks*